US006260276B1

(12) United States Patent
Lebherz et al.

(10) Patent No.: US 6,260,276 B1
(45) Date of Patent: Jul. 17, 2001

(54) HAIR CLIPPING MACHINE WITH DEVICE FOR ADJUSTING LENGTH OF CUT

(75) Inventors: Robert Lebherz, Villingen-Schwenningen; Günter Wursthorm, Triberg; Ismail Altindis, Furtwangen, all of (DE)

(73) Assignee: Moser Electrogerate GmbH, Unterkirnach (DE)

( * ) Notice: Subject to any disclaimer, the term of this patent is extended or adjusted under 35 U.S.C. 154(b) by 0 days.

(21) Appl. No.: 09/355,859

(22) PCT Filed: Feb. 27, 1998

(86) PCT No.: PCT/DE98/00587

§ 371 Date: Jun. 9, 2000

§ 102(e) Date: Jun. 9, 2000

(87) PCT Pub. No.: WO98/38016

PCT Pub. Date: Sep. 3, 1998

(30) Foreign Application Priority Data

Feb. 28, 1997 (DE) ..... 197 08 145

(51) Int. Cl.[7] ..... B26B 19/20

(52) U.S. Cl. ..... 30/201; 30/200

(58) Field of Search ..... 30/200–202, 210, 30/216

(56) References Cited

FOREIGN PATENT DOCUMENTS

| | | |
|---|---|---|
| 813 003 | 9/1951 | (DE) . |
| 11 93 834 | 12/1969 | (DE) . |
| 32 46258 A1 | 12/1982 | (DE) . |
| 43 17 530 A1 | 5/1993 | (DE) . |
| 54-54757 | 5/1979 | (JP) . |

*Primary Examiner*—Douglas D Watts
(74) *Attorney, Agent, or Firm*—Foley, Hoag & Eliot LLP

(57) ABSTRACT

The invention relates to a hair clipping machine with a device for adjusting the length of a cut, with the adjusting device acting upon the clipping assembly. The clipping assembly includes at least a fixed clipping comb and a clipping blade which can be driven in an oscillatory motion essentially parallel to the front edge of the clipping comb. The adjusting device includes of at least an actuating element which is connected to the clipping blade via coupling elements for displacing the clipping blade lengthwise. The adjusting device is an integral part of the clipping assembly and may therefore be configured independently of the housing. As a result, construction is simplified and it is also possible to retrofit clipping machines which do not have such adjustment devices.

16 Claims, 9 Drawing Sheets

HAIR CLIPPING MACHINE WITH DEVICE FOR ADJUSTING LENGTH OF CUT

FIELD OF THE INVENTION

The invention relates to a hair clipping machine, in particular to a hair clipping machine adapted to adjust the length of the cut.

BACKGROUND OF THE INVENTION

Hair clipping machines with a device for adjusting the length of the cut are disclosed in, for example, DE 33 10 706 C2. These hair clipping machines include a cutting assembly consisting of a fixed clipping comb and a clipping blade that can be driven in an oscillatory motion parallel to the front edge, i.e., in a transverse direction. The clipping blade has a fork-shaped catch which engages with an eccentric pin of the drive motor.

The underside of the clipping comb has a beveled contour. The length of the cut is adjusted by moving the clipping blade with respect to the front edge of the clipping comb in the longitudinal direction. For this purpose, an actuating element in the form of a slider is provided which is supported in the housing. The actuating element acts on the clipping blade through gear teeth. A displacement of the actuating element therefore causes a displacement of the clipping blade in the longitudinal direction.

This mechanism for displacing the clipping blade to adjust the desired length of the cut can be quite complex. In particular, the coupling element, which converts the displacement of the slider, which is supported in the housing, into the desired longitudinal displacement of the clipping blade, has to be carefully constructed.

The German patent DE-PS 814 117, which form a basis for the present invention, describes a hair clipping machine, wherein the device for changing the length of the cut is greatly simplified. The device for adjusting the length of the cut includes a carriage which is supported for longitudinal movement relative to the clipping comb and to which the clipping blade is secured. The device also includes an adjustment lever effecting the carriage and positioning the carriage between two end positions. The assembly of the cutting assembly and the device for adjusting the length of the cut, however, requires that all components be connected to the housing of the hair clipping machine, which can become quite complicated. This applies in particular to the support of the adjustment lever on the housing. According to a first embodiment described in the above-referenced patent, the adjustment lever is supported by a bolt of a tightening screw which holds the entire machine together at the center. In other words, all components have to be inserted sequentially and separately, until they can be secured with the tightening screw. According to another embodiment described in the above-referenced patent, the adjustment lever may be supported by an axial bolt which extends completely through the housing.

Another type of cutting assembly is disclosed in U.S. Pat. No. 1,774,046 wherein a knurled screw is used to displace the clipping comb relative to a base plate. The base plate is screwed to the housing. A clearance is provided between the clipping comb which is movably supported in the housing, and the housing section located above the comb to receive the clipping blade which can be driven with an oscillatory motion. The support of the clipping blade is very important, since the clipping blade is essentially merely inserted between the clipping comb and the housing and guided by the drive pin of the motor.

JP 54-54757 discloses an improved arrangement for guiding a clipping blade with respect to a fixed clipping comb. Supporting blocks are provided in the region of the clipping comb. Each of the supporting blocks receives a respective spring element which is attached to the cutting blade. The spring elements are designed so that the clipping blade can oscillate freely transversely to the clipping comb, while being biased against the clipping comb . With this arrangement, however, the length of the cut cannot be adjusted, since the cutting blade has a fixed axial position with respect to the clipping comb.

It is therefore an object of the invention to improve the hair clipping machine of the type described above so as to eliminate the aforedescribed disadvantages. More particularly, it is an object of the invention to simplify the design and thereby also the manufacture of the device for adjusting the length of the cut.

SUMMARY OF THE INVENTION

According to one aspect of the invention, the complete device for adjusting the length of the cut is fully integrated in the cutting assembly, with the cutting blade supported so as to be able to oscillate freely. Accordingly, the actuating element is also part of the cutting assembly. The entire cutting assembly, which includes the device for adjusting the length of the cut, can now be constructed as a separate assembly which is separate from the housing. This greatly simplifies the design and construction of the device, since no actuating elements for adjusting the lengths of the cut are disposed on the housing. In addition, hair clipping machines which have interchangeable cutting assemblies, may be provided with optional devices for adjusting the length of the cut without changing the design of the hair clipping machines. In addition, existing hair clipping machines that lack a device for adjusting the length of the cut, may be upgraded by a simple change of the cutting assembly without the need for modifying the machine itself.

In addition, two support blocks which receive at least one spring element, are also provided on the carriage. The cutting blade is connected to the at least one spring element so that the clipping blade is continuously biased against the clipping comb and supported with a parallelogram-type guide arrangement.

Preferably, a support member is provided which receives the carriage. The support member is secured to the clipping comb, preferably in the region of a comb plate which is integrally formed with or attached to the clipping comb. In this way, the carriage is held and guided on the support member and thereby also on the clipping comb and the comb plate, respectively.

According to a preferred embodiment of the invention, the actuating element is rotatably supported on the support member and/or on the comb plate. No additional components are required with this type of support. Instead, the actuating element can be supported by pins and corresponding bores in a manner known in the art. With this type of support, the carriage can be controllably displaced simply by rotating or tilting the actuating element. The desired position can thereby be adjusted very precisely and, for example, secured with conventional locking devices known in the art.

The rotation and tilting motion of the actuating element can be readily transformed into the desired translation or displacement motion of the carriage with the help of a retaining pin which engages and cooperates with a corresponding slotted groove. The retaining pin can be attached, for example, to the actuating element and cooperate with the slotted groove disposed on the carriage. Alternatively, it would also be possible to attach the retaining pin to the carriage and the slotted groove on the actuating element.

Alternatively, a gear wheel can also be attached to the actuating element, wherein the gear wheel cooperates with at least one corresponding rack segment disposed on the carriage.

To transmit the force more evenly, two gear wheels are advantageously arranged symmetrically with respect to the longitudinal axis, rotating in opposite directions. The gear wheels cooperate with two corresponding rack segments disposed symmetrically with respect to the longitudinal axis on the carriage. The force is then applied exactly symmetrically with respect to the longitudinal axis of the carriage. This eliminates jamming which may occur if the force is applied predominantly from one side.

The cutting assembly of the invention which includes the device for adjusting the length of the cut, may also be designed so that either the clipping comb and/or the support member are attached to the housing, with the clipping blade being moved to adjust the length of the cut. Alternatively, the carriage may be affixed to the housing, and the length of the cut is adjusted by adjusting the position of the clipping comb.

The clipping comb may also be displaced by providing an additional holder which is connected with the support member, with the clipping comb supported in the holder for displacement in the longitudinal direction.

Other preferred embodiments of the invention reduce the complexity of assembling the cutting assembly, including the device for adjusting the length of the cut. For example, the support member and the holder, and possibly also the comb plate and the holder may be formed from a thermoplastic material and heat-fused after the individual components, in particular the carriage and the actuating element, have been fitted together. This type of assembly technique obviates the use of screws.

The invention will be described hereinafter with reference to the embodiment illustrated in the drawings.

DESCRIPTION OF THE PREFERRED EMBODIMENT

In the following detailed description of the figures, corresponding elements have the same reference numbers. Only the differences between the various embodiments and the basic design will be described.

Figure 1:
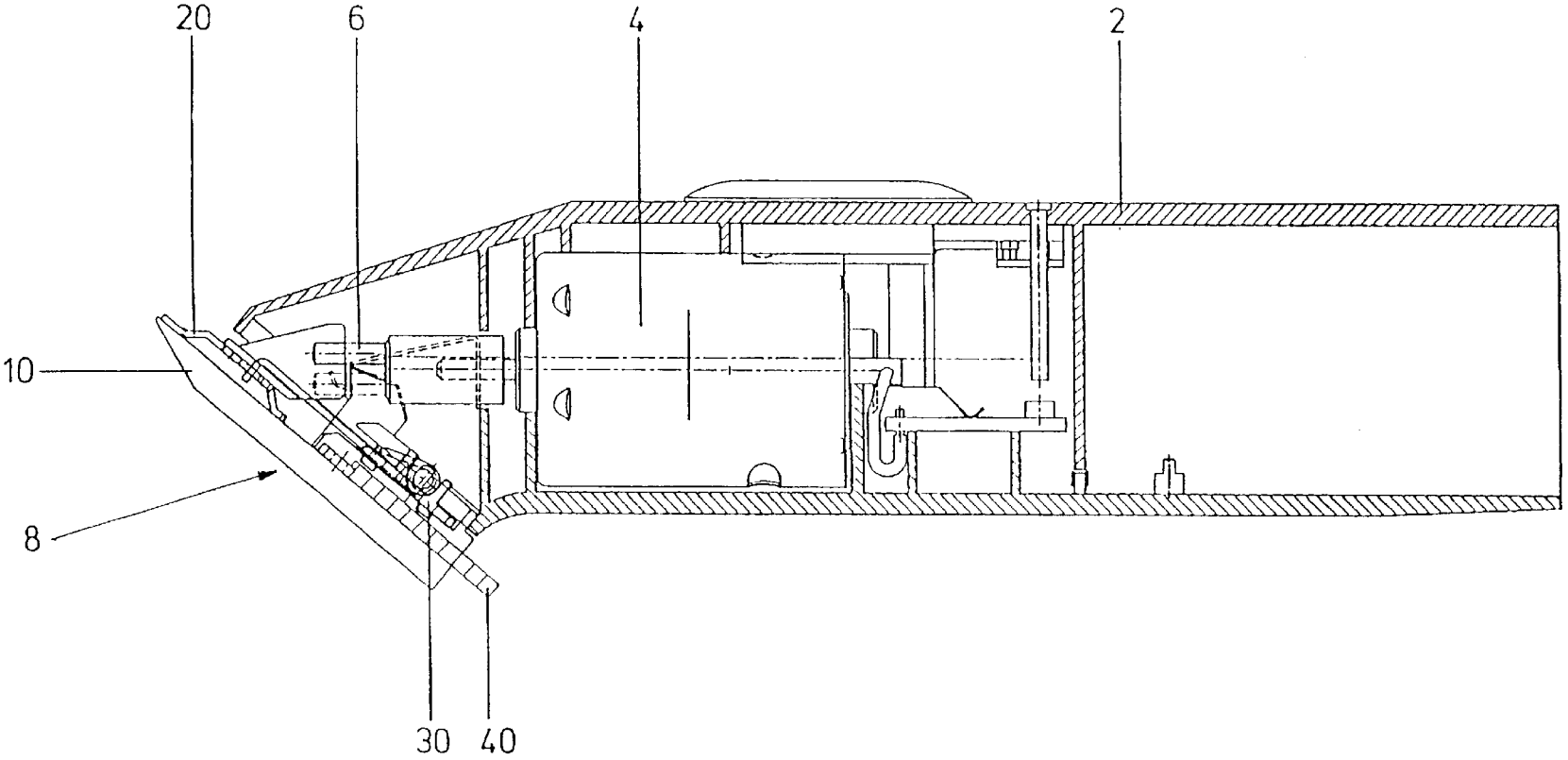
FIG. 1 is a longitudinal cross-section of a basic design of a hair clipping machine.

Referring now to FIG. 1, the basic design of a hair clipping machine with a device for adjusting the length of the cut includes a drive motor 4 which is inserted in a housing 1. The drive motor 4 drives a clipping blade 20 in an oscillatory motion in the transverse direction, i.e., in a plane which is perpendicular to the plane of the longitudinal section. The clipping blade 20 faces a clipping comb 10, with the clipping blade 20 and the clipping comb 10 forming a clipping assembly 8. The clipping assembly 8 is releasably connected to the housing 2 for interchangeablility, which is known in the art.

According to one feature of the invention, integrated into the clipping assembly 8 is a device for adjusting the length of the cut. The clipping blade 20 can be displaced in the longitudinal direction to adjust the desired length of the cut. The device for adjusting the length of the cut consists essentially of an actuating element 40 acting on a carriage 30. The carriage 30 is connected to the clipping blade 20, so that the displacement motion of the carriage 20 is directly transmitted to the clipping blade 20.

As seen from FIG. 1, it is not necessary to provide additional components on the housing for displacing the clipping blade 20 relative to the clipping comb 30 in the longitudinal direction. In other words, the desired length of the cut is adjusted with the help of components which are integrated in the clipping assembly 8. The clipping assembly 8 can therefore be advantageously made interchangeable with existing cutting assemblies which lack adjustability. Consequently, existing hair clipping devices can be easily upgraded.

Various modifications for implementing the device for adjusting the length of the cut will now be described with reference to the remaining figures. The following embodiments are intended to show the various arrangements of actuating elements 40 and coupling elements which can be used to adapt the displacement motion of the carriage 30.

Figure 2A:
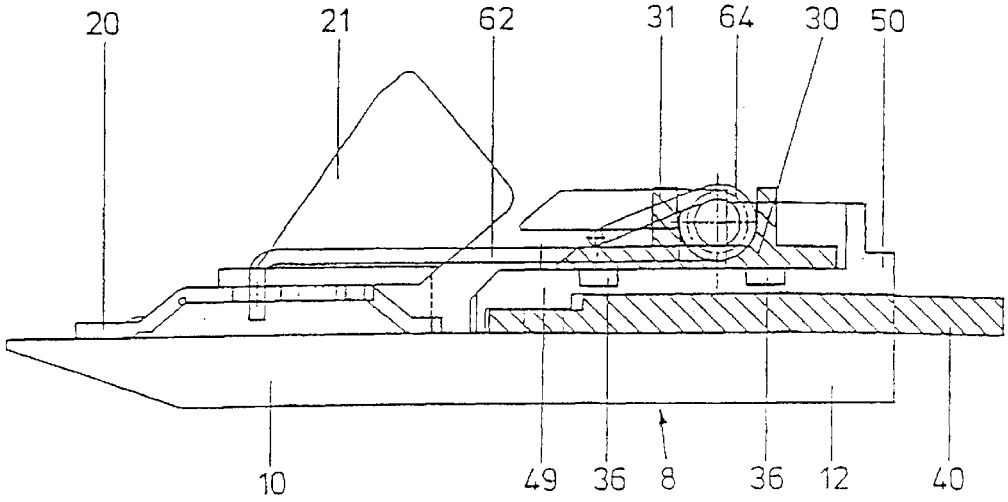
FIG. 2*a* is a longitudinal section of a cutting assembly, with a pin guided in a slotted groove.
Figure 2B:
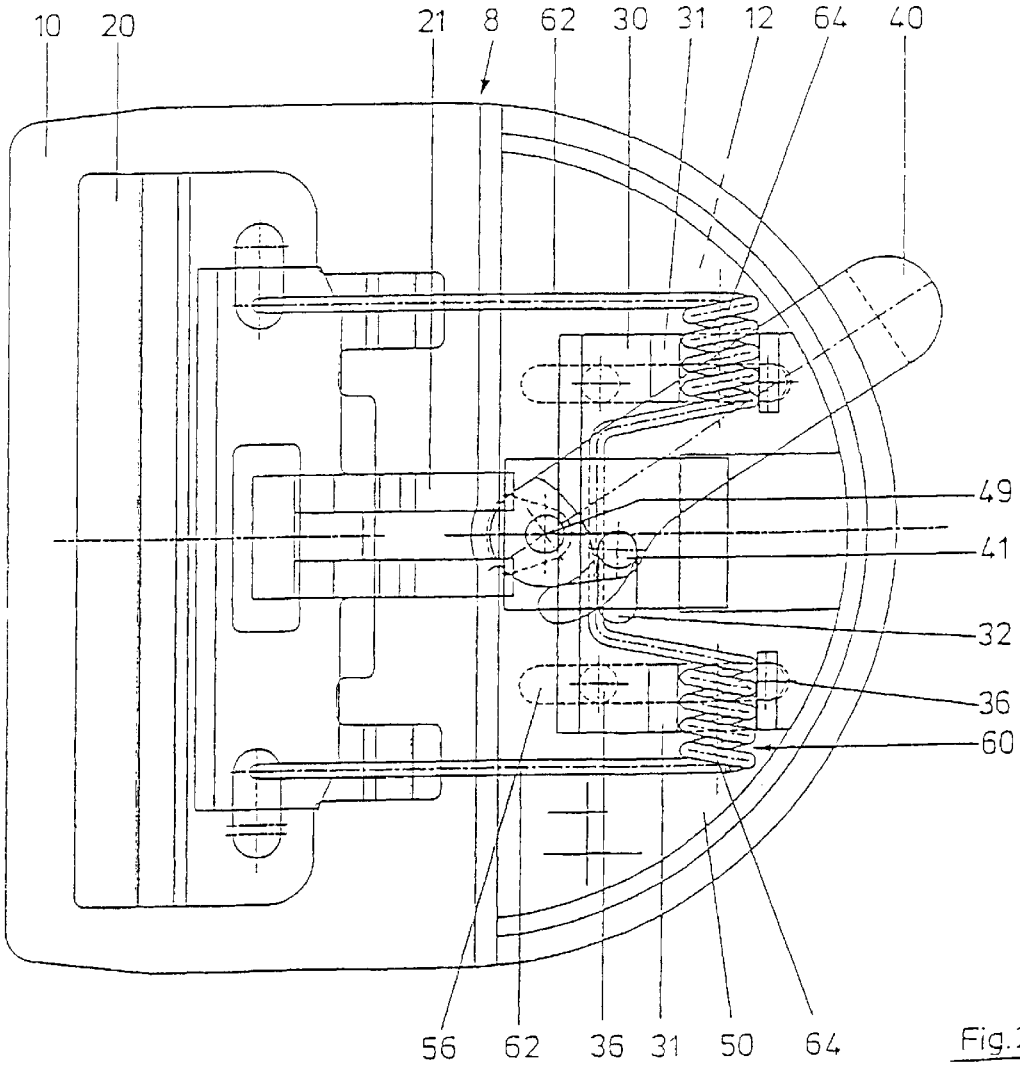
FIG. 2*b* is a top view of the cutting assembly according to FIG. 2*a;*
Figure 2C:
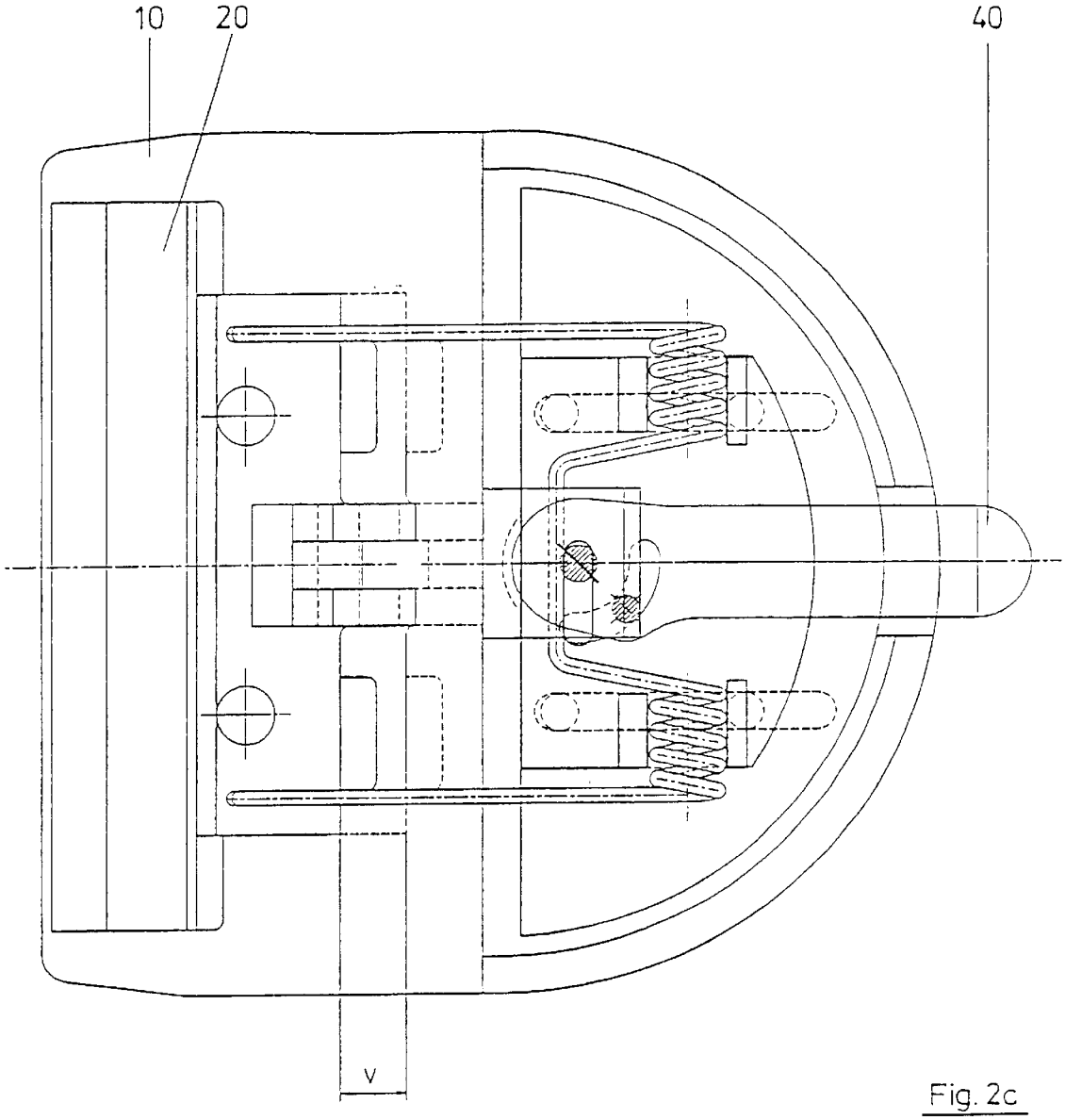
FIG. 2*c* is the cutting assembly according to FIG. 2*b* with the clipping blade in a different position.

FIGS. 2*a*–2*c* show an enlarged view of the clipping assembly 8 of FIG. 1. The design of the actuating element 40 is also different. A comb plate 12 which supports the entire device for adjusting the length of the cut, forms one piece with the clipping comb 10. The clipping blade 20 is disposed in the front region and can be driven by the cam 6 (not shown) via a catch 21.

The actuating element 40 is formed as a pivoting lever and guided between the comb plate 12 and a support member 50. The actuating element 40 includes a pin 41 which engages with a corresponding groove 32 formed on the carriage 30. The carriage 30 can be engaged and moved in the direction of the front edge of the clipping comb 10 by pivoting the actuating element 40 about a pivot axis 49, until the position illustrated in FIG. 2C is reached. The maximum length of the displacement B is defined by the length of the slotted groove 32 in conjunction with the arrangement of the pin 41 relative to the actuating element 40.

The carriage 30 includes additional guide pins 36 which engage in guide grooves 56 of the support member 50. This arrangement assures that the carriage 30 is displaced exactly in the longitudinal direction, even if—as in the present example—the force effecting the displacement of the carriage is applied off-center.

According to a particular embodiment of the carriage, two support blocks 31 for supporting a spring element 60 are symmetrically formed on the carriage 30. The spring element 60 is formed as one piece and includes two spaced apart, mutually parallel spring legs 62 and two spring coils 64 which are used to insert the spring element 60 into the support blocks 31. The end portions of the spring legs 62 make contact with the clipping blade 20, thereby providing a connection with the carriage 30. The spring coils 64 produce a biasing force which continually urges the clipping blade 20 against the clipping comb 10. In addition, the arrangement of the spring arms 62 represents a parallelogram guide which enables the oscillatory displacement motion transversely to the longitudinal axis.

Figure 3A:
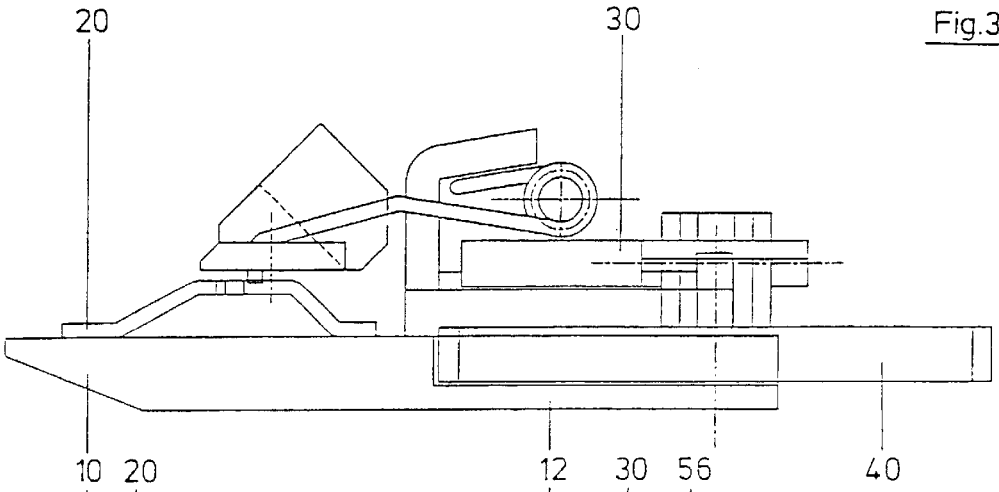
FIG. 3*a* is a longitudinal section of the cutting assembly with an adjustment wheel for symmetric force transmission.
Figure 3B:
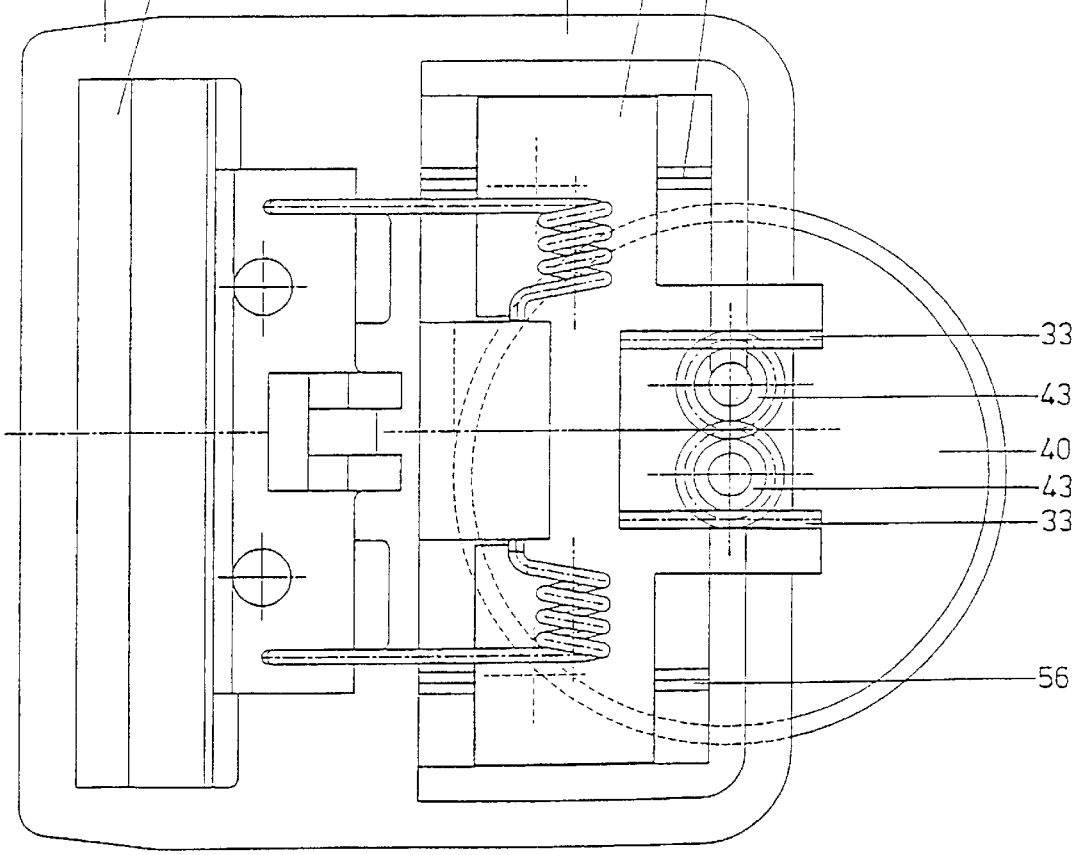
FIG. 3*b* is a top view of the cutting assembly of FIG. 3*a;*

In the embodiment of the invention illustrated in FIGS. 3A and 3B, the actuating element 40 is an adjustment wheel which drives two meshing gear wheels 43. Each of the gear wheels 43 engages with a rack segment 33 attached to the carriage 30. A rotating motion of the adjustment wheel is thereby converted into a linear displacement motion of the carriage 30. With this type of coupling between the actuating element 40 and the carriage 30, the force applied to the carriage 30 is completely symmetric with respect to the longitudinal axis, i.e., in a direction parallel to the displacement direction. The actuating forces can thus be kept small, since the carriage 30 can no longer become wedged in the groove 56.

Figure 4A:
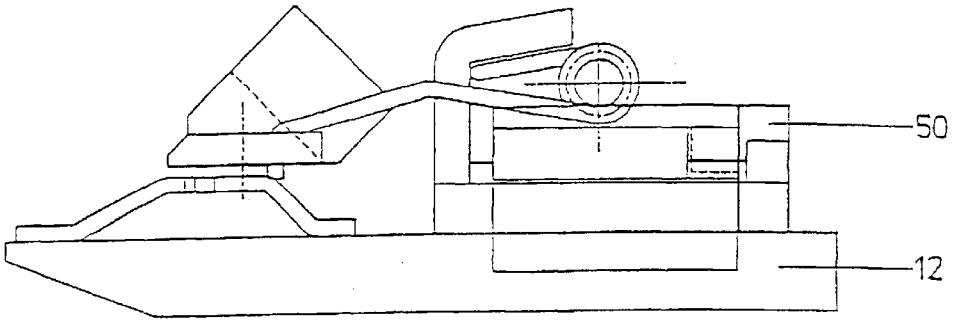
FIG. 4*a* is a longitudinal section of the cutting assembly with an eccentric lever and a displacement slider.

According to the embodiment illustrated in FIGS. 4A and B, the actuating element 40 is an eccentric lever which is supported off-center between the comb plate 12 and the support member 50 for rotation above the pivot axis 39. One end of the eccentric lever includes a pin 41 which engages the carriage 30 in the region of a shoulder disposed on the slider 34.

The actuating element 40 in this embodiment can be arranged slightly to the side of the clipping assembly 8. The device for adjusting the length of the cut has the additional ergonometric advantage that it can be operated with the thumb when the hair clipping machine is in use.

Figure 5:
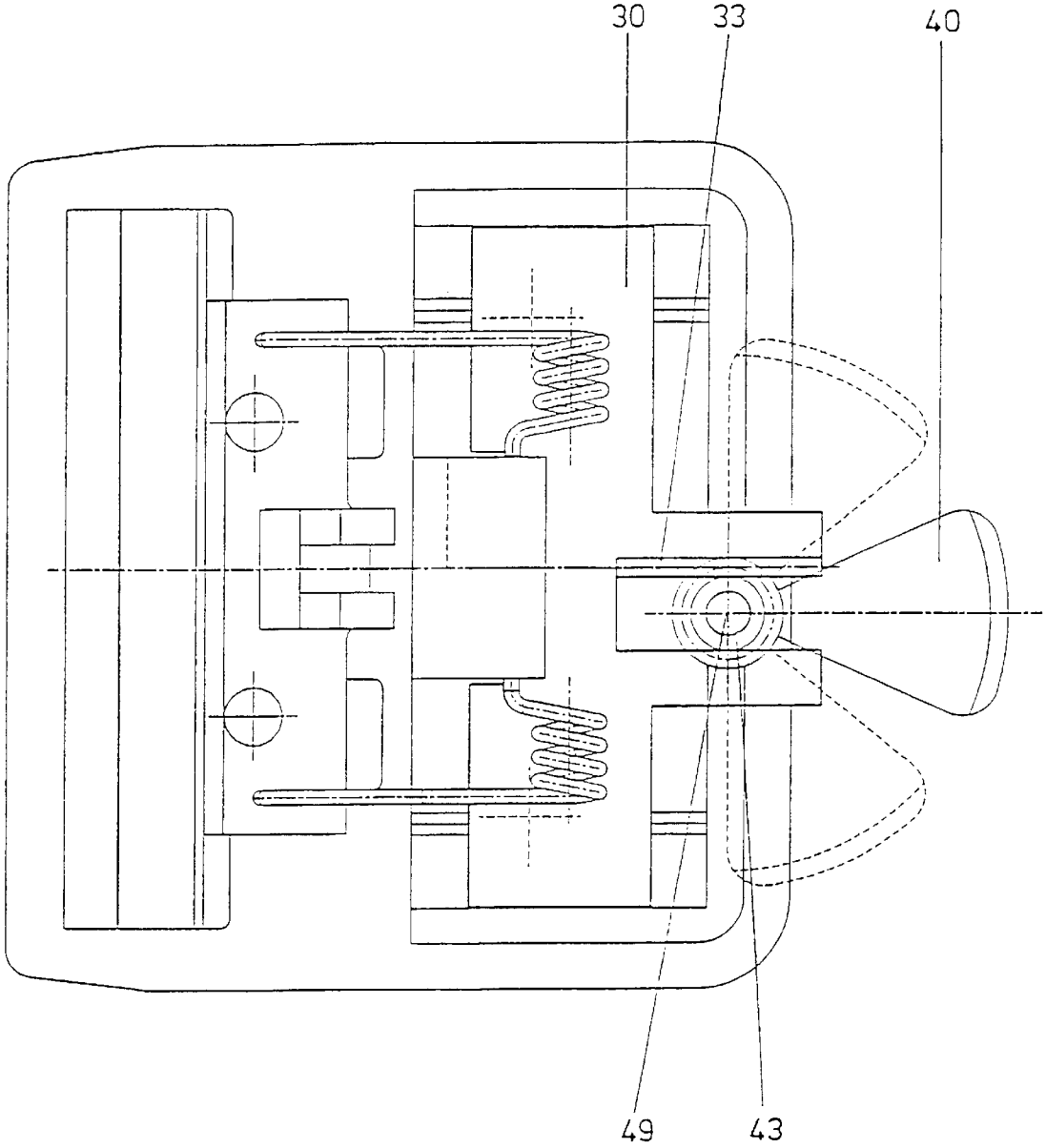
FIG. 5 is a top view of the cutting assembly with a pivoting lever, with the gear wheel acting on one side.

The design of the embodiment shown in FIG. 5 is particularly simple. The actuating element 40 is a pivoting lever supporting a single gear wheel 43. The gear wheel 43 is aligned with a rack segment 33 of the carriage 30. The carriage 30 can be displaced linearly by rotating the pivoting lever.

The arrangement illustrated in FIG. 5 has the added advantage that the line of engagement of the rack segment 33 coincides with the symmetry axis of the clipping assembly 8. The pivot axis 49 of the pivoting lever is here disposed slightly off-center, so that the force can be applied symmetrically to prevent the carriage 30 from becoming wedged.

Figure 6:
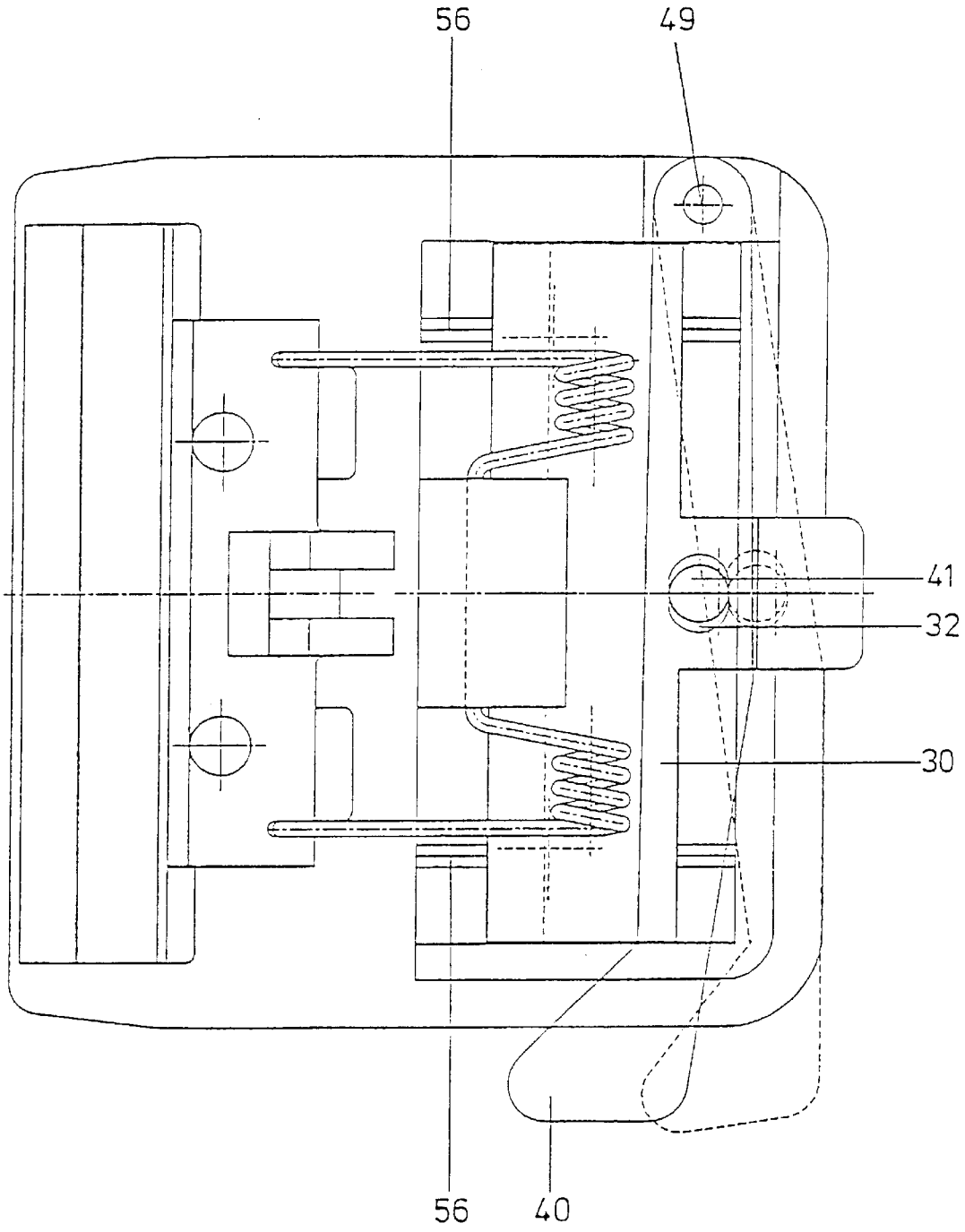
FIG. 6 is a top view of the cutting assembly with an eccentric lever, with the pin acting in the center.

Referring now to the embodiment of FIG. 6, an actuating element 40 has the form of an eccentric lever which is also supported off-center for rotation about the pivot axis 49. A pin 41 which engages a groove 32 disposed on the carriage 30, is disposed on the eccentric lever.

Figure 4B:
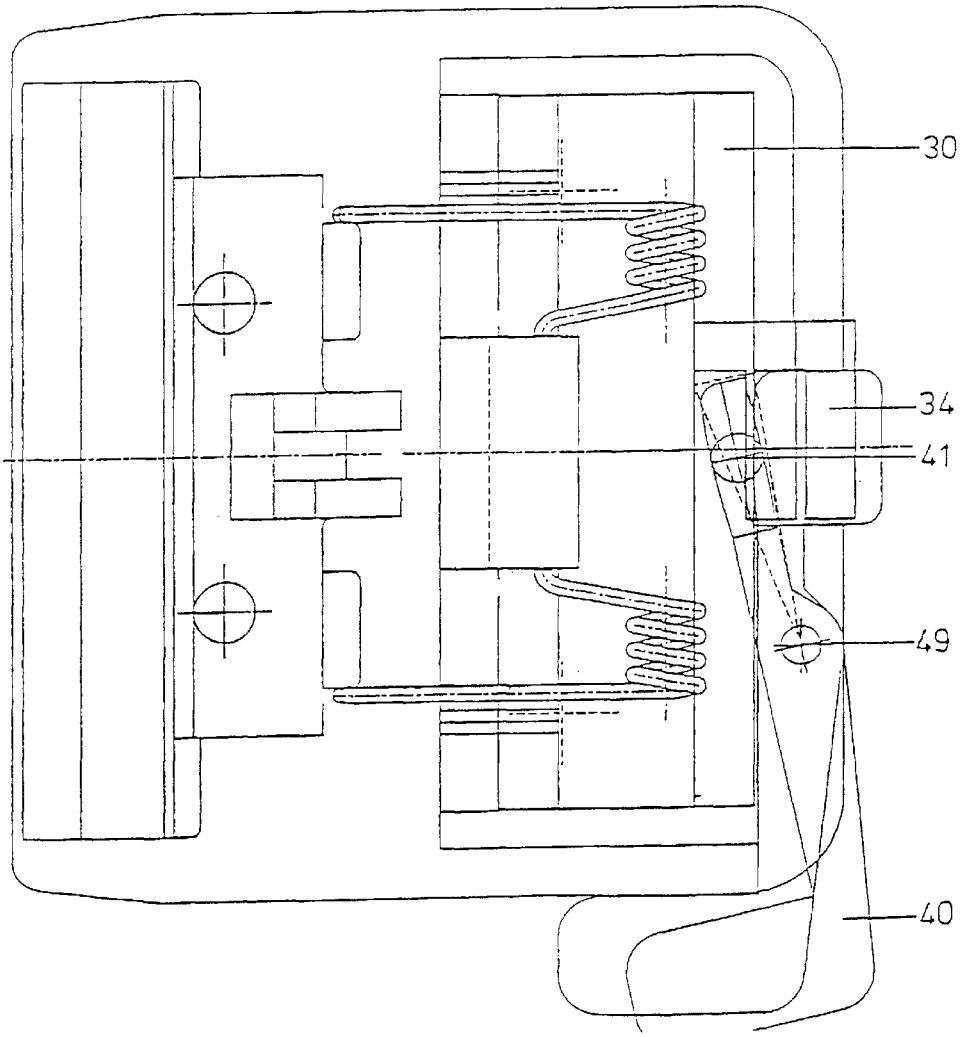
FIG. 4*b* is a top view of the cutting assembly according to FIG. 4*a;*

Unlike the embodiment of FIGS. 4A and 4B, the pivot axis 49 is here positioned as far away from the symmetry axis as possible, which, allows the attack point of the force on the carriage 30 with respect to the symmetry axis to be maintained at an essentially fixed position. When the carriage is moved between the two end points, the attack point of the pin 41 moves only a very small distance relative to the carriage 30. This small movement is further compensated by the guide grooves 56.

Figure 7:
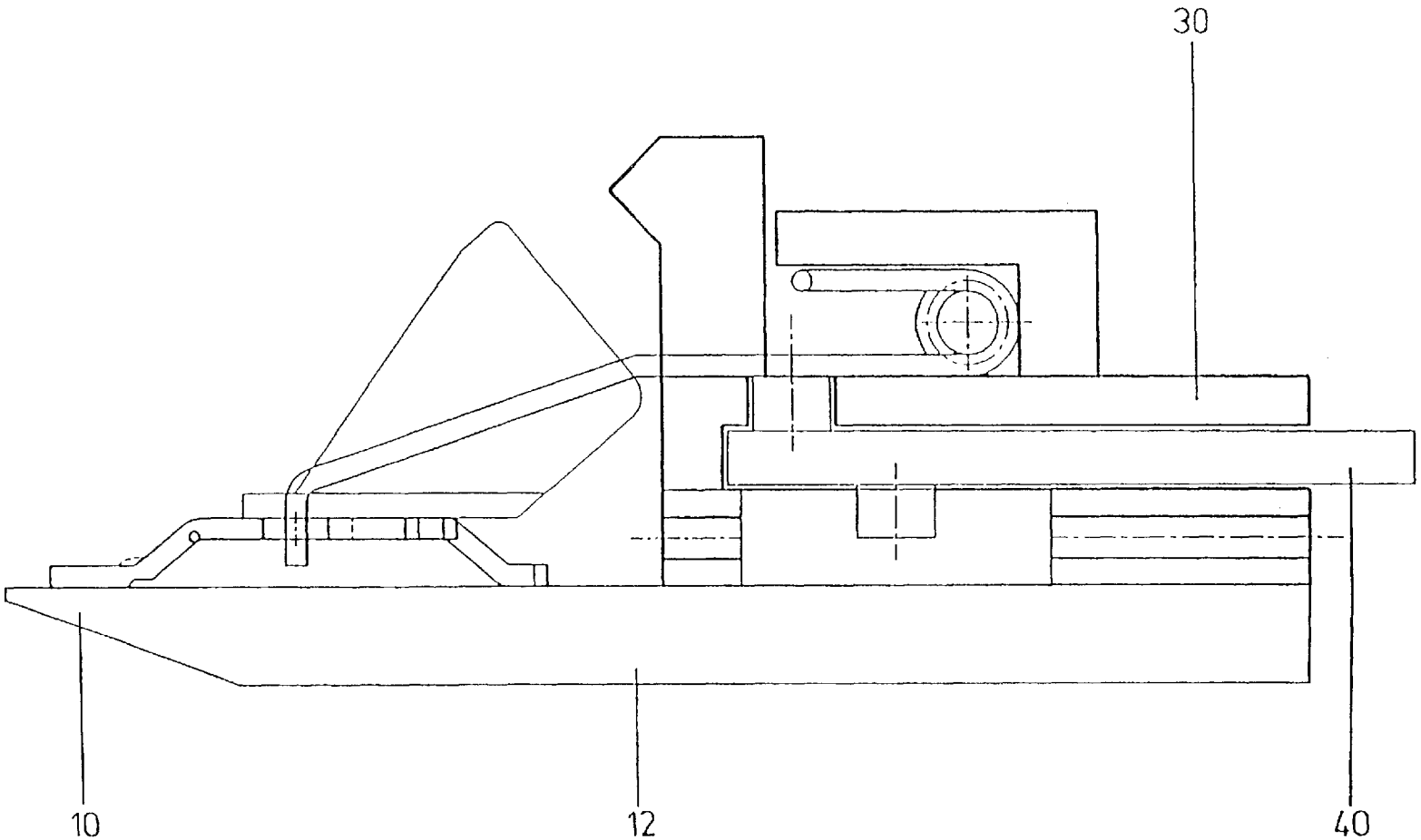
FIG. 7 is a longitudinal section of the cutting assembly, with the carriage secured to the housing.

The carriage 30 of the embodiment shown in FIG. 7 can be secured to a housing 2 (not shown). For this purpose, the carriage 30 includes support ribs which engage with corresponding grooves disposed on the housing 2. Actuation of the actuating element 40 then causes the comb plate 12 together with the clipping comb 10 to be displaced in the longitudinal direction.

Figure 8:
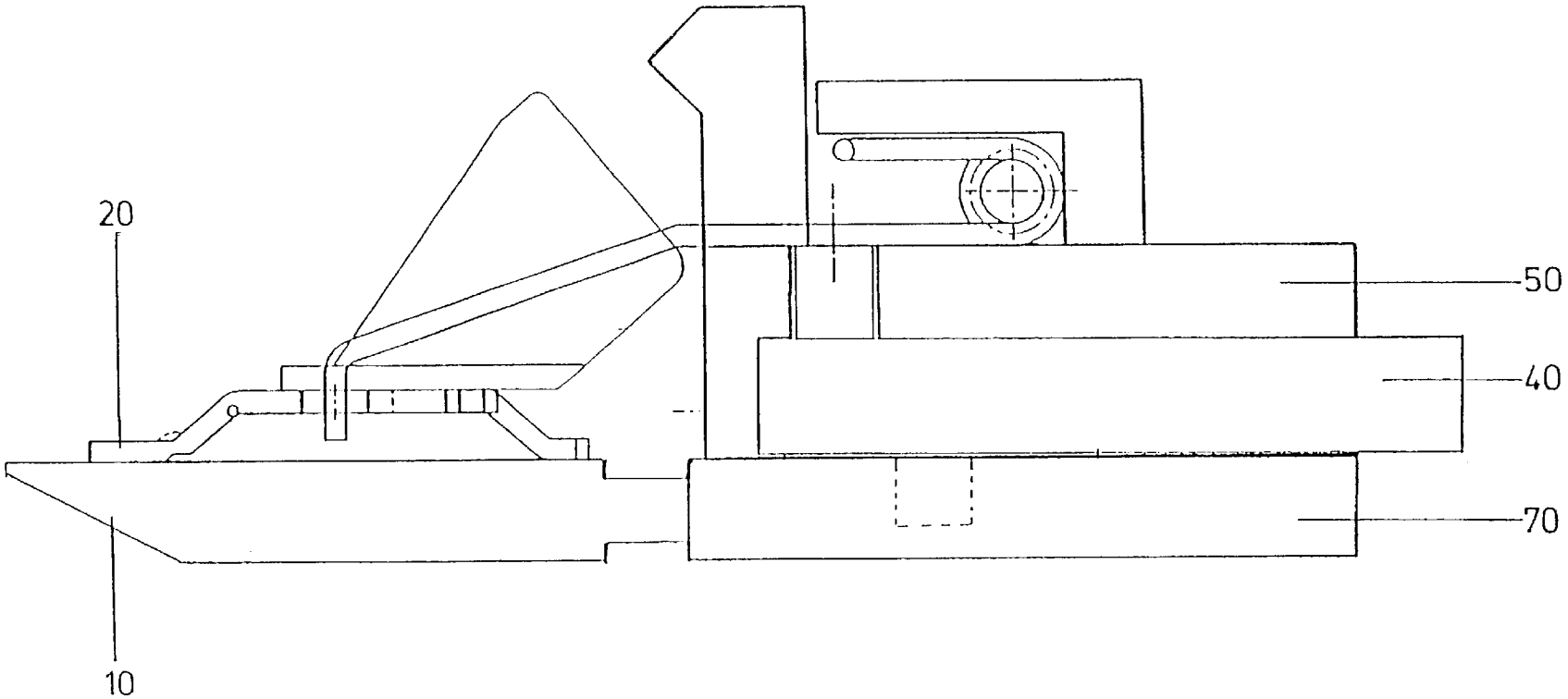
FIG. 8 is a longitudinal section of the cutting assembly, with the clipping comb pulled out.

Referring now to the embodiment illustrated in FIG. 8, the length of the cut can be adjusted by displacing the clipping comb 10. A holder 70 is connected to the support member 50, wherein the clipping comb 10 is guided in the holder for longitudinal displacement. The actuating element 40 acts directly on the clipping comb 10 and displaces the clipping comb 10 relative to the clipping blade 20.

The aforedescribed arrangement is easier to manufacture, since the support member 50 can be fused with the holder 70, if both components are made of a thermoplastic plastic. In this way, conventional fasteners, such as screws or rivets, may be completely eliminated.

What is claimed is:

1. A hair clipping machine with an adjustable length of a cut, comprising:

a clipping assembly comprising at least one fixed clipping comb and a moveable clipping blade which can be driven essentially parallel to a front edge of the clipping comb in a transverse direction, and an adjustment device for adjusting the length of the cut, the adjustment device comprising at least one actuating element and a carriage, wherein the carriage is supported for longitudinal movement with respect to the clipping comb, is coupled to the clipping blade, and can be positioned by the actuating element in the region between a front end position and a rear end position, and wherein actuating element is coupled to the carriage by coupling elements, and enables displacement of the carriage in a longitudinal direction perpendicular to the front edge of the clipping blade, wherein the adjustment device is integrated in the clipping assembly, wherein there are provided two support blocks attached to the carriage, with at least one spring element inserted in the support blocks, wherein the at least one spring element is connected to the clipping blade in such a way, that the clipping blade is continually biased against the clipping comb and simultaneously supported in a parallelogram-type guide arrangement, and wherein the length of the cut can be adjusted by operating the adjustment device.

2. The hair clipping machine according to claim 1, wherein the support blocks are formed as a single piece with the carriage.

3. The hair clipping device according to claim 2, further comprising a support member which receives the carriage, and a comb plate formed as a single piece with the clipping comb, wherein the carriage is appended to the clipping comb in a region of the comb plate.

4. The hair clipping machine according to claim 3, wherein the actuating element is rotatably supported on at least one of the support member and the comb plate.

5. The hair clipping machine according to claim 3, further comprising a drive pin disposed on one of the actuating element and the carriage, wherein the drive pin engages with a corresponding slotted groove disposed on the other of the carriage and the actuating element.

6. The hair clipping machine according to claim 2, further comprising at least one gear wheel attached to the actuating element, wherein the gear wheel cooperates with at least one corresponding rack segment disposed on the carriage.

7. The hair clipping machine according to claim 6, wherein two gear wheels are disposed symmetrically with respect to the longitudinal axis and rotate in opposite directions, wherein the gear wheels cooperate with two corresponding rack segments which are arranged symmetrically with respect to the longitudinal axis.

8. The hair clipping machine according to claim 3, wherein at least one of the clipping comb and the support member can be locked with respect to a housing.

9. The hair clipping machine according to claim 1, wherein the carriage can be locked with respect to a housing.

10. The hair clipping machine according to claim 9, further comprising a holder connected to the support member, wherein the clipping comb is supported by the holder for linear displacement in the longitudinal direction.

11. The hair clipping machine according to claim 10, characterized in that the support member and the holder are formed of a thermoplastic material and are fused together.

12. The hair clipping machine according to claim 10, further comprising a comb plate formed as a single piece with the clipping comb, wherein the comb plate and the holder are formed of a thermoplastic material and fused together.

13. Hair clipping machine comprising:

a housing;

a motor disposed in said housing; and a clipping assembly releasably attached to the housing, the clipping assembly including:

a clipping comb stationary with respect to the housing, and a clipping blade driven by said motor in an oscillatory motion in a direction substantially perpendicular to a longitudinal axis of the housing; and an adjustment device for adjusting a length of a cut, wherein the adjustment device comprises:

a carriage moveable in the axial direction and coupled to the clipping blade, a resilient element biasing said clipping blade against the clipping comb, and an actuator coupled to the carriage for moving said carriage, wherein the direction of the oscillatory motion of the clipping blade is independent of the movement of the carriage and the clipping blade in the axial direction, and wherein said resilient element is supported on the carriage and forms a parallelogram guide mechanism to maintain the direction of the oscillatory motion of the clipping blade independent of the movement of the carriage and the clipping blade in the axial direction.

14. An integrated clipping assembly for a hair clipping machine, comprising:

a stationary support member having an end face formed as a clipping comb;

a carriage guided on said support member for displacement in a direction substantially perpendicular to said end face;

an actuator coupled to said carriage for displacing said carriage;

a clipping blade resiliently biased against said clipping comb and adapted for oscillatory movement substantially parallel to said end face, and a parallelogram guide mechanism for coupling the clipping blade to the carriage, wherein the clipping blade is coupled to said carriage so as to be displaced with the carriage while maintaining an orientation substantially parallel to said end face.

15. The integrated clipping assembly of claim 14, wherein said parallelogram guide mechanism comprises a spring secured to the carriage, with the spring biasing the clipping blade against said clipping comb.

16. The integrated clipping assembly of claim 14, herein displacement of the carriage by the actuator causes a change in a cutting length of the integrated clipping assembly.

* * * * *

UNITED STATES PATENT AND TRADEMARK OFFICE

CERTIFICATE OF CORRECTION

PATENT NO. : 6,260,276 B1
DATED : July 17, 2001
INVENTOR(S) : Robert Lebherz et al.

It is certified that error appears in the above-identified patent and that said Letters Patent is hereby corrected as shown below:

Title page,
Item [75], Inventors, change "Wursthorm" to -- Wursthorn --.
Item [73], Assignee, change "Electrogerate" to -- Elektrogerate --.

Signed and Sealed this

Twentieth Day of August, 2002

*Attest:*

*Attesting Officer*

JAMES E. ROGAN
*Director of the United States Patent and Trademark Office*